United States Patent [19]

Abele

[11] 4,358,529

[45] Nov. 9, 1982

[54] PHOTOSENSITIVE REPRODUCTION ELEMENTS FOR FORMING NEGATIVE TONABLE IMAGES

[75] Inventor: Werner Abele, Neu-Isenburg, Fed. Rep. of Germany

[73] Assignee: E. I. Du Pont de Nemours and Company, Wilmington, Del.

[21] Appl. No.: 274,558

[22] Filed: Jun. 17, 1981

[30] Foreign Application Priority Data

Dec. 22, 1980 [DE] Fed. Rep. of Germany ..... 3048490

[51] Int. Cl.[3] ..... G03C 1/68; G03C 1/727

[52] U.S. Cl. ..... 430/270; 430/291; 430/913; 430/919; 430/920; 430/921

[58] Field of Search ..... 430/270, 281, 291, 269, 430/913, 919, 920, 921

[56] References Cited

U.S. PATENT DOCUMENTS 3,479,185 11/1969 Chambers ..... 430/281
3,615,454 10/1971 Cescon et al. ..... 430/270
3,652,275 3/1972 Baum et al. ..... 430/269
4,243,741 1/1981 Abele et al. ..... 430/270
4,271,260 6/1981 Abele et al. ..... 430/270

*Primary Examiner*—Jack P. Brammer

[57] ABSTRACT

A nonsilver photosensitive reproduction element which comprises a support bearing a layer of a photosensitive composition which comprises (1) at least one thermoplastic binder, (2) a photosensitive system consisting essentially of (a) a hexaarylbiimidazole compound and (b) a dihydropyridine compound; and optionally (3) a plasticizer, and (4) a thioamide, thiolactam or thiocarbanilic acid ester of the formula:

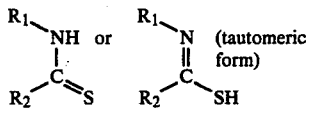

wherein $R_1$ and $R_2$ are as defined. The photosensitive element is useful in preparing negative tonable images.

6 Claims, No Drawings

PHOTOSENSITIVE REPRODUCTION ELEMENTS FOR FORMING NEGATIVE TONABLE IMAGES

DESCRIPTION

TECHNICAL FIELD

This invention relates to new photosensitive nonsilver elements, and more particularly to negative-working photosensitive elements.

BACKGROUND ART

In the area of photographic reproduction technology photopolymerizable layers are useful in photosensitive reproduction elements, in which differences in tackiness between the exposed and unexposed areas of the photosensitive layer are used to produce the image. The images are made visible by applying suitable colored toners which adhere only to the unexposed, tacky areas so that a positive of the original is formed.

The photosensitive system of such reproduction elements contains as free radical producing initiators, e.g., combinations of hexaarylbisimidazoles with mercapto compounds, as they are described in German Pat. Nos. 1 904 058, 2 004 214 and German Published Application 2 243 182. The mercapto compounds serve as hydrogen donors and increase the effectiveness of hexaarylbisimidazoles.

An element, however, is also known from Abele and Grossa U.S. Pat. No. 4,243,741 which is not based on photopolymerization and in which the unexposed areas are nontacky. The exposed areas, upon imagewise exposure, become tacky and can be made visible with a suitable toner, thereby forming a negative image. This element utilizes a dihydropyridine compound and a hexaarylbisimidazole compound. This element, however, is less sensitive in contrast to photopolymer systems and requires longer exposure times by a factor of 10.

An object of this invention is to improve the sensitivity of elements that have a photosensitive system of a hexaarylbisimidazole compound and a dihydropyridine compound.

In accordance with this invention there is provided in a photosensitive nonsilver reproduction element for the preparation of negative tonable images comprising a support bearing a layer of a photosensitive composition which comprises (1) at least one thermoplastic binder, (2) a photosensitive system of (a) a hexaarylbisimidazole compound and (b) a dihydropyridine compound; and (3) optionally a plasticizer, the improvement wherein there is present in the composition (4) a thioamide, thiolactam or thiocarbanilic acid ester of the formula:

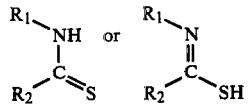

wherein $R_1$ and $R_2$ can be the same or different and can be H, alkyl of 1 to 4 carbon atoms and aryl of 6 to 10 carbon atoms; $R_1$ is aryl of 6 to 10 carbon atoms and $R_2$ is either oxyalkyl wherein alkyl is of 1 to 8 carbon atoms or thioaryl wherein aryl is phenyl, tolyl, naphthyl; and $R_1$ and $R_2$ when taken together can be members of a 5 to 7 membered heterocyclic ring which may contain oxygen, sulfur and nitrogen as additional heteroatoms.

Although some of the mercapto compounds defined in the above general formula, e.g., 2-mercaptobenzthiazole and 2-mercaptobenzoxazole, are used in photopolymer compositions as co-initiators for an increase of sensitivity, it was not anticipated, that these compounds would also be effective in a photosensitive system which is based on a completely different mechanism than photopolymerization. There is also no correlation between the activity of mercapto compounds as co-initiators in photopolymerizable materials and their utility in the photosensitive materials of the invention.

Thus, for example, the 2-mercaptobenzimidazoles and 2-mercaptobenzthiazoles, disclosed in U.S. Pat. No. 3,479,185 as very good co-initiators, are less well suited for the purposes of the invention while 2-mercaptothiazoline, only moderately effective as co-initiator, has proven to be especially well suited.

Sensitivity increases by the factor of 1.5–3.0 can be obtained by the addition of thio compounds of the invention.

Examples of especially suitable thio compounds are summarized in Tables 1, 2 and 3 below. Useful $R_1$ substituents include: H, alkyl, e.g., $CH_3$, $C_2H_5$, $C_3H_7$, $C_4H_9$; aryl, e.g., phenyl ($C_6H_5$), naphthyl ($C_{10}H_7$) and substituents thereof, e.g., $C_6H_4Cl$, $C_6H_4OCH_3$, $C_6H_4OC_2H_5$, and alkaryl, e.g., $—CH_2C_6H_5$, $C_6H_4CH_3$, etc. Useful $R_2$ substitutents include: H, alkyl, e.g., those described above; aryl, e.g., phenyl ($C_6H_5$), naphthyl ($C_{10}H_7$), etc.

TABLE 1

(Thioamides)

| Compound | $—R_1$ | $R_2$ |
|---|---|---|
| 1/1 | —H | —H |
| 1/2 | —H | $—CH_3$ |
| 1/3 | H | $—C_6H_5$ |
| 1/4 | $—CH_3$ | —H |
| 1/5 | $—CH_3$ | $—CH_3$ |
| 1/6 | $—CH_2—C_6H_5$ | $—C_6H_5$ |
| 1/7 | $—C_6H_5$ | —H |
| 1/8 | $—C_6H_5$ | $—CH_3$ |
| 1/9 | $—C_6H_5$ | $—C_2H_5$ |
| 1/10 | $—C_6H_5$ | $—C_4H_9$ |
| 1/11 | $—C_6H_4Cl$ | $—CH_3$ |
| 1/12 | $—C_6H_4Cl$ | $—C_4H_9$ |
| 1/13 | $—C_6H_4—CH_3$ | $—C_4H_9$ |
| 1/14 | $—C_6H_4—O—CH_3$ | $—CH_3$ |
| 1/15 | $—C_6H_4—O—CH_3$ | $—C_2H_5$ |
| 1/16 | $—C_6H_4—O—CH_3$ | $—C_4H_9$ |
| 1/17 | $—C_6H_4—O—C_2H_5$ | $—CH_3$ |
| 1/18 | $—C_6H_4—O—C_2H_5$ | $—C_2H_5$ |
| 1/19 | $—C_6H_5$ | $—C_6H_5$ |

TABLE 2

Thiolactams and/or Tautomeric Mercapto Compounds

| Compound | $—R_1 \quad R_2—$ |
|---|---|
| 2/1 | $—CH_2—CH_2—CH_2—$ |
| 2/2 | $—CH_2—CH_2—S—$ |
| 2/3 | $—CH(CH_3)—CH_2—S—$ |
| 2/4 | $—CH_2—CH(CH_3)—S—$ |
| 2/5 | $—C(CH_3)_2—CH_2—S—$ |
| 2/6 | $—CH_2—C(CH_3)_2—S—$ |
| 2/7 | $—CH_2—CH_2—O—$ |
| 2/8 | $—CH(CH_3)—CH_2—O—$ |
| 2/9 | $—C(CH_3)_2—CH_2—O—$ |
| 2/10 | $—CH{:}CH—N(CH_3)—$ |
| 2/11 | $—CH_2—CH_2—CH_2—S—$ |
| 2/12 | $—CH_2—CH_2—CH(CH_3)—S—$ |
| 2/13 | $—CH_2—CH_2—CH_2—O—$ |
| 2/14 | $—CH{:}CH—CH{:}CH—$ |
| 2/15 | $—CH_2—CH_2—CH_2—CH_2—CH_2—$ |

TABLE 2-continued

| Thiolactams and/or Tautomeric Mercapto Compounds | | |
|---|---|---|
| Compound | —$R_1$ | $R_2$— |
| 2/16 | 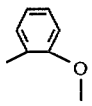 | |
| 2/17 | 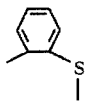 | |

TABLE 3

| (Thiocarbanilic acid esters) | | |
|---|---|---|
| Compound | —$R_1$ | $R_2$ |
| 3/1 | —$C_6H_5$ | —O—$CH_3$ |
| 3/2 | —$C_6H_5$ | —O—$C_2H_5$ |
| 3/3 | —$C_6H_5$ | —O—$CH(CH_3)_2$ |
| 3/4 | —$C_6H_5$ | —O—$CH_2$—$CH(CH_3)_2$ |
| 3/5 | —$C_6H_5$ | —O—$CH_2$—$CH_2$—O—$C_6H_5$ |
| 3/6 | —$C_6H_5$ | —S—$C_6H_4$—$CH_3$ |

Preferred compounds are 1/6, 1/9, 1/18, 2/2, 2/14, 2/15, 3/1 and 3/2. Single compounds as well as their mixtures can be used. The total concentration of thio compounds is between 5 and 40% by weight, based on the total weight of solids in the photosensitive layer.

Some thioamides, thiolactams and/or their tautomeric mercaptocompounds of the invention are commercial products. Where this is not the case, they can be obtained either by reaction of the analogous acid amine with phosphorous pentasulfide, e.g., according to the directives in Berichten der der Deutschen Chemischen Gesellschaft 22 (1889), page 906, or the Annalen der Chemie 407 (1915), page 407, or they can be prepared according to other processes described in the literature, e.g., according to the Berichten der deutschen Chemischen Gesellschaft 36 (1903), page 1281. The production of thiocarbanilic acid-O-alkylester of the invention is known from the literature (e.g., Berichte der Deutschen Chemischen Gesellschaft 2 (1869) page 120 and occurs by the reaction of phenylisothiocyanate with alcohols. The production of dithiocarbanilic acid-S-arylester occurs analogously by reaction of phenylisothiocyanate with arylmercaptans.

Suitable dihydropyridine compounds, which are used in combination with the thio compounds of the invention are described in U.S. Pat. No. 4,243,741. They are characterized by the formula:

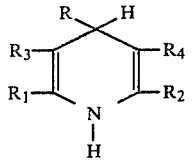

wherein R is alkyl, alkenyl of 3 to 11 carbon atoms, phenylalkyl, phenylalkenyl, aryl of 6 to 10 carbon atoms or unsubtituted heteroaryl; $R_1$ and $R_2$, which can be the same or different are alkyl, preferably a methyl or ethyl group; and $R_3$ and $R_4$, which can be the same or different, are COOR', COR', CN, R' is alkyl, e.g., alkyl of 1 to 11 carbon atoms.

The dihydropyridine compounds are used in concentrations from 5 to 40% by weight, based on the total weight of solids in the photosensitive layer either singley or as a mixture of several dihydropyridine compounds.

The photosensitive system also contains hexaarylbisimidazole compounds. Preferred compounds are described in German Pat. No. 1 300 013. The hexaarylbisimidazole compounds are used in a concentration from 20 to 60% by weight, based on the total weight of solids in the photosensitive layer. Two or more hexaarylbisimidazole compounds can be used together advantageously.

Polymeric binders useful in the elements are thermoplastic polymers, e.g.,

- Polyacrylic acid- and/or methacrylic acid esters, as well as mixed polymers with acrylic- and/or methacrylic acid or other acrylic- and/or vinyl monomers, chlorine containing vinyl polymers and/or mixed polymers, e.g., polyvinyl chloride, as well as the afterchlorination products,
- polyvinylidine chloride, chlorinated polyethylene, etc.,
- Polystyrene and polystyrene mixed polymers,
- Ethylene and ethylene mixed polymers, e.g., with maleic acid, etc.,
- Synthetic rubber varieties based on butadiene, chloroprene, etc., and their mixed polymers, e.g., with styrene, acrylonitrile, etc.,
- Polyether, e.g., high-molecular polyethylene oxides or polyepichlorohydrin, etc.

The binders can be present in the light-sensitive layers in quantities from 10% to 75% by weight based on the total weight of solids in the layer. Optionally, plasticizers can be added to the binder. The following plasticizers have proven to be especially suitable:

- Glycol esters or glycol ethers, e.g., triethylene glycol diacetate, ethylene glycol dibutyrate, etc.,
- Phthalic acid esters, e.g., dioctylphthalate, etc.,
- Phosphoric acid esters, e.g., tricresylphosphate, trioctylphosphate, etc.,
- Ester aliphatic dicarboxylic acids, e.g., esters of adipic acid such as dibutyladipate, etc.

The amount of plasticizer is determined by the binder used and should be measured so that the unexposed layer is not yet tacky. The change in tackiness brought about by imagewise exposure is sufficient to to produce a total tackiness sufficient to hold the toner to the exposed areas. Quantities from 0% to 40% by weight plasticizer, based on the total weight solids of the photosensitive have proven to be suitable.

Sterically hindered phenols, e.g., 2,6-di-tert.-butylphenol, 2,4,6-tri-tert.-butylphenol or 2,2'-methylene-bis-(4-ethyl-6-tert.-butylphenol) are used to improve stability in storage. The addition is in amounts of 0.5 to 5%, preferably from 1.5 to 3% by weight based on the total weight of solids of the photosensitive layer.

In addition to the above ingredients the photosensitive layers of the invention optionally can contain additional additives, e.g., sensitizers, optical brightners, matting agents, wetting agents, etc. Among others, benzophenone or Michler's ketone have proven to be especially useful as sensitizers.

A large number of transparent or opaque materials are useful as supports for the photosensitive layers. Examples are: papers, optionally baryta-coated; cardboard, metal films, e.g., aluminum, copper, steel, etc.; wood, glass, ceramic, films or fiber webs of natural or synthetic polymers, e.g., polyamides, elastomers, polyethylene or -propylene, linear polyesters, e.g., polyethylene terephthalate; cellulose, cellulose esters, polyvinyl chloride or their mixed polymers, polyacrylonitrile, etc.

If necessary, still additional layers, e.g., an adhesive layer, an intermediate layer capable of being peeled off, a pigmented layer, a diffusion barrier layer and a halation protective layer can be present on the support. A special protective film over the photosensitive layer, which must be removed before toning, is not necessary. It can, however, be applied to prevent damage to the photosensitive layer.

Ingredients of the photosensitive layer are applied according to known methods generally as a solution in volatile solvents and are subsequently dried. Suitable solvents include: methylene chloride, acetic acid ethyl ester, acetone, etc. The concentration of nonvolatile ingredients in the casting solution can vary within wide limits. The concentration depends on the casting process and the desired layer thickness. Other methods of application, without using solvents are useful such as calendering, extrusion, etc.

Colored powders of the most varied composition can be used for toning the exposed layer. Suitable toners are inorganic or organic pigments and soluble organic dyes. The individual particles can be provided with a shell of a suitable polymeric material to improve handling. Suitable toners are disclosed, e.g., in German Pat. No. 1,210,321, and U.S. Pat. Nos. 3,620,726, 3,649,268 and 3,909,282 which are all incorporated by reference.

Toning is carried out either manually with the help of a wad of cotton or with a special application device. The image thus can be produced directly on the support bearing the exposed photosensitive layer. If desired, this image can be transferred to another material or substrate. According to another embodiment the photosensitive layer is transferred before exposure to the final support and is exposed and toned there. Depending on the choice of the support material prints as well as transparencies can be produced.

To produce multicolor images several images toned in the individual colors are placed or laminated on top of each other, or several exposures are taken of the same layer behind various cover sheets and are toned by applying different colored toners.

The exposure of the layer is by means of an ultraviolet light or radiation source. A wave length of 300–400 nm is preferred. The necessary exposure time, depending on the sensitivity of the photosensitive composition, type, intensity, and distance of the light source used, is between 5 and 50 seconds.

The photosensitive reproduction element of the invention, has the same advantageous properties as described in U.S. Pat. No. 4,243,741 for a negatively tonable system: thus, no screened relief images are necessary to produce halftone images. Even nonscreened halftone images can be reproduced with comparable gradation. It is also possible in case of underexposure to raise the density of the toned image by postexposure and posttoning. Additionally, the element of the invention, in contrast to photopolymer elements, is not sensitive to oxygen, so that measures to exclude oxygen, e.g., special oxygen-impermeable protective films or protective layers, or conditioning of the material in nitrogen or other inert gases, are not required.

INDUSTRIAL APPLICABILITY

The photosensitive elements are useful for the reproduction of negative images in many applications, e.g., direct color separation technology, single and multicolor images from masters, etc.

EXAMPLES

The following Examples illustrate the invention.

EXAMPLE 1

While stirring, the following ingredients are successively dissolved in 300 ml methylene chloride:

3 g Plexisol® B 372 polyethylacrylate having a dynamic viscosity at 20° C. in a 30% solution in ethyl acrylate of 7 to 12 Pascal-seconds and viscosity number, 2.5 deciliters/gram 6 g 2-(o-ethoxyphenyl)-4,5-diphenylimidazolyl dimer.

The solution is divided into three equal parts, to which the following compounds are added:

(a)

1.0 g 1,4-dihydro-2,4,6-trimethylpyridine-3,5-dicarboxylic acid-diethylester (b)

1.0 g thioproprionylanilide, 1/9

(c)

0.5 g 1,4-dihydro-2,4,6-trimethylpyridine-3,5-dicarboxylic acid-diethylester 0.5 g thiopropionylanilide, 1/9

Solutions (a), (b) and (c) are spread separately onto a white pigmented polyethylene terephthalate support and are dried. The coating weight of the dried film is about 50 mg/dm$^2$. The three samples are exposed successively behind a step wedge cover sheet with a wedge constant of 0.1 using a 1000 watt UV-light source at a distance of about 60 cm for 40 seconds. Subsequently the layers are toned with a black pigment using a wad of cotton. The toner adheres only to the exposed areas. The nonadhering toner is removed with a clean wad of cotton. Black and white negatives of the step wedge cover sheet are obtained. Although the gradation of about 1 is approximately the same with all three samples, sample (c) exhibits 3 wedge steps more than samples (a) and (b), corresponding to a doubling of sensitivity.

EXAMPLE 2

While stirring, the following are successively dissolved in 100 ml each of methylene chloride:

(a)

1.5 g polyethylacrylate as described in Example 1

2.5 g 2-(o-chlorophenyl)-4,5-diphenyl imidazolyl dimer 1.0 g 1,4-dihydro-2,6-dimethyl-4-ethylpyridine 3,5-dicarboxylic acid diethylester (b)

1.5 g polyethylacrylate as described in Example 1

2.5 g 2-(o-chlorphenyl)-4,5-diphenyl imidazoly dimer 0.75 g 1,4-dihydro-2,6-dimethyl-4-ethylpyridine-3,5-dicarboxylic acid diethylester 0.25 g thiopropionyl-p-ethoxyanilide, 1/18

The samples are spread and processed as described in Example 1. In spite of the smaller amount (5%) of the added thio compound, sample (b) shows a sensitivity of 160% in contrast to comparative example (a) with 100%.

EXAMPLE 3

While stirring, the following are successively dissolved in 100 ml each of methylene chloride:

(a)

1.0 g polyethylmethacrylate, high molecular weight polymer having an inherent viscosity of 0.92
2.5 g 1,4-dihydro-2,6-dimethyl-4-ethylpyridine-3,5-dicarboxylic acid diethylester
1.5 g 2-(o-ethoxyphenyl)-4,5-diphenyl imidazolyl dimer (b)

1.0 g polyethylmethacrylate as described in (a) above
0.5 g 1,4-dihydro-2,6-dimethyl-4-ethylpyridine-3,5-dicarboxylic acid diethylester
0.5 g thiopropionylanilide, 1/9
0.5 g 2-mercaptothiazoline, 2/2
0.5 g thiocaprolactam, 2/15
0.5 g thiocarbanilic acid-O-ethylester, 3/2
1.5 g 2-(o-ethoxyphenyl)-4,5-diphenyl imidazolyl dimer Both samples are spread and processed as described in Example 1. Sample (b) shows a sensitivity of 160% in contrast to 100% of sample (a).

EXAMPLE 4

While stirring, the following are successively dissolved in 300 ml each of methylene chloride:

3.0 g polyethylacrylate described in Example 1
6.0 g 2-(o-ethoxyphenyl)-4,5-diphenyl imidazolyl dimer
1.5 g 1,4-dihydro-2,6-dimethyl-4-propylpyridine 3,5-dicarboxylic acid diethylester.

The solution is divided into three equal parts, to which one of the following ingredients is added:

(a)

0.5 g 1,4-dihydro-2,6-dimethyl-4-propylpyridine 3,5-dicarboxylic acid diethylester (b)

0.5 g thiocarbanilic acid-O-ethylester, 3/2

(c)

0.5 g thiocarbanilic acid-O-isobutylester, 3/4

All three samples are coated and processed as described in Example 1. Evaluation indicated the following sensitivity:

Sample (a) (control) 100%
Sample (b) 200%
Sample (c) 160%

EXAMPLE 5

While stirring, the following are successively dissolved in 100 ml each of methylene chloride:

(a)

1.0 g poly(n-butylmethacrylate)
0.5 g 1,4-dihydro-2,6-dimethyl-4-ethylpyridine-3,5-dicarboxylic acid diethylester
0.5 g 1,4-dihydro-2,6-dimethyl-4-propylpyridine-3,5-dicarboxylic acid diethylester
2.0 g 2,4,5-triphenyl imidazolyl dimer (b)

1.0 g poly(n-butylmethacrylate)
0.2 g 1,4-dihydro-2,6-dimethyl-4-ethylpyridine-3,5-dicarboxylic acid diethylester
0.2 g 1,4-dihydro-2,6-dimethyl-4-propylpyridine-3,5-dicarboxylic acid diethylester
0.2 g 2-mercaptothiazoline, 2/2
0.4 g 2-mercaptobenzthiazole, 2/17
2.0 g 2,4,5-triphenyl imidazolyl dimer Samples (a) and (b) are spread and processed as described in Example 1. Sample (b) in contrast to sample (a) (100%) exhibits a sensitivity of 160%.

EXAMPLE 6

While stirring, the following are successively dissolved in 100 ml each of methylene chloride:

(a)

1.0 g polyethylacrylate as described in Example 1
1.0 g 1,4-dihydro-2,4,6-trimethylpyridine-3,5-dicarboxylic acid-diethylester
2.0 g 2,4,5-triphenyl imidazolyl dimer (b)

1.0 g polyethylacrylate as described in Example 1
0.6 g 1,4-dihydro-2,4,6-trimethylpyridine-3,5-dicarboxylic acid-diethylester
0.4 g dithiocarbanilic acid-S-p-tolylester, 3/6
2.0 g 2,4,5-triphenyl imidazolyl dimer.

Samples (a) and (b) are spread and processed as described in Example 1. Sample (b) in contrast to sample (a) (100%) exhibits a sensitivity of 160%.

I claim:

1. Photosensitive nonsilver reproduction element for the preparation of negative tonable images comprising a support bearing a layer of a photosensitive composition which comprises (1) at least one thermoplastic binder,
(2) a photosensitive system consisting essentially of
(a) at least one hexaarylbisimidazole compound;
(b) a dihydropyridine compound; and
(c) a thioamide, thiolactam or thiocarbanilic acid ester of the formula:

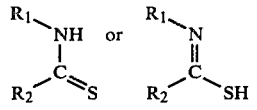

wherein $R_1$ and $R_2$ can be the same or different and can be H, alkyl of 1 to 4 carbon atoms and aryl of 6 to 10 carbon atoms; $R_1$ is aryl of 6 to 10 carbon atoms and $R_2$ is either oxyalkyl wherein alkyl is of 1 to 8 carbon atoms or thioaryl wherein aryl is phenyl, tolyl, naphthyl; and $R_1$ and $R_2$ when taken together can be members of a 5 to 7 membered heterocyclic ring which may contain oxygen, sulfur and nitrogen as additional heteroatoms; and optionally (3) a plasticizer.

2. An element according to claim 1 characterized in that there is present a thioamide compound taken from thiopropionic acid anilide, thiobenzoic acid benzylamide and thioaceto-p-ethoxyanilide.

3. An element according to claim 1 characterized in that there is present a thiolactam compound taken from 2-mercaptothiazoline, 2-mercaptopyridine and ω-thiocaprolactam.

4. An element according to claim 1 characterized in that there is present a thiocarbanilic acid ester compound taken from thiocarbanilic acid-O-ethylester, thiocarbanilic acid-O-isopropylester and dithiocarbanilic acid-S-p-tolylester.

5. An element according to claim 1, claim 2, claim 3 or claim 4, characterized in that the photosensitive layer contains two or more thioamide, thiolactam and thiocarbanilic acid ester compounds.

6. An element according to claim 1 characterized in that the thioamide, thiolactam, thiocarbanilic acid ester or mixture is present in an amount of 5 to 40% by weight based on the total weight of solids in the photosensitive layer.

* * * * *